United States Patent [19]

Leatherman

[11] Patent Number: 4,888,869

[45] Date of Patent: Dec. 26, 1989

[54] LOCK-BAR FOLDABLE TOOL

[75] Inventor: Timothy S. Leatherman, Portland, Oreg.

[73] Assignee: Leatherman Tool Group, Inc., Portland, Oreg.

[21] Appl. No.: 194,394

[22] Filed: May 16, 1988

Related U.S. Application Data

[63] Continuation-in-part of Ser. No. 853,349, Apr. 17, 1986, Pat. No. 4,744,272.

[51] Int. Cl.[4] ..... B26B 1/04

[52] U.S. Cl. ..... 30/161; 30/152; 30/153; 30/158

[58] Field of Search ..... 30/151–155, 30/158–161, 164, 143

[56] References Cited

U.S. PATENT DOCUMENTS

| | | | |
|---|---|---|---|
| 358,312 | 2/1887 | Weck | 30/161 |
| 445,509 | 1/1891 | Thayer | 30/158 |
| 949,231 | 2/1910 | Libby | 30/155 X |
| 1,472,826 | 11/1923 | Champlin | 30/152 X |

*Primary Examiner*—D. S. Meislin

*Attorney, Agent, or Firm*—Chernoff, Vilhauer, McClung & Stenzel

[57] ABSTRACT

A lock-back foldable tool includes a folding locking channel which nests outside of the channel-shaped handle of the tool. The locking channel fits closely over a spring, integral with the web of the channel-shaped handle, which bears against a cam surface on the base of the tool blade. When the blade is in extended position with respect to the handle, pivoting of the blade with respect to the handle will cause deflection of the spring. When the locking channel is selectively positioned over the spring, it prevents deflection of the spring, thereby locking the blade into extended position.

14 Claims, 6 Drawing Sheets

FIG. 2
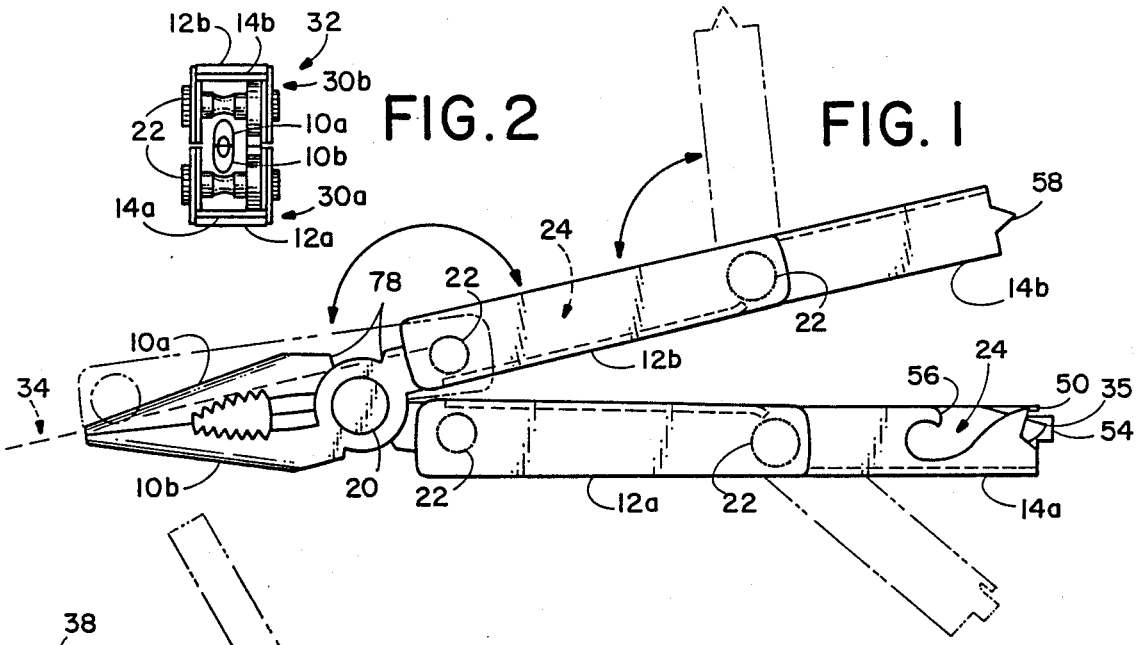
FIG. 1
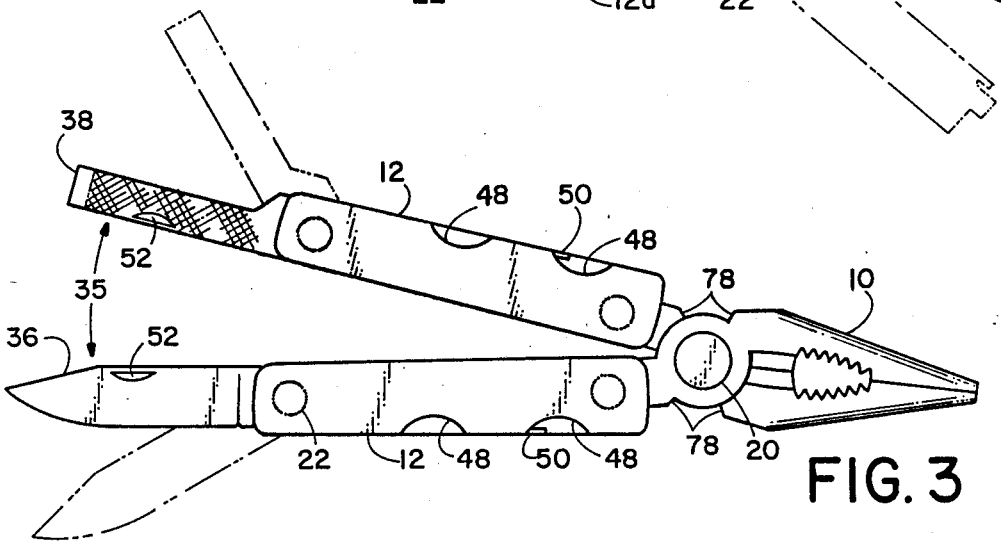
FIG. 3
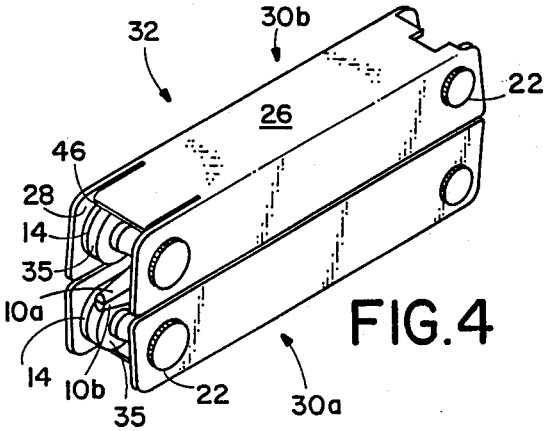
FIG. 4
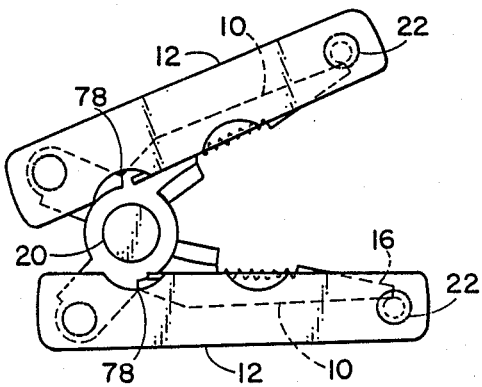
FIG. 12
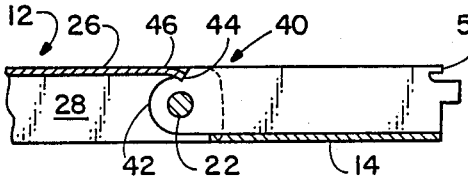
FIG. 5

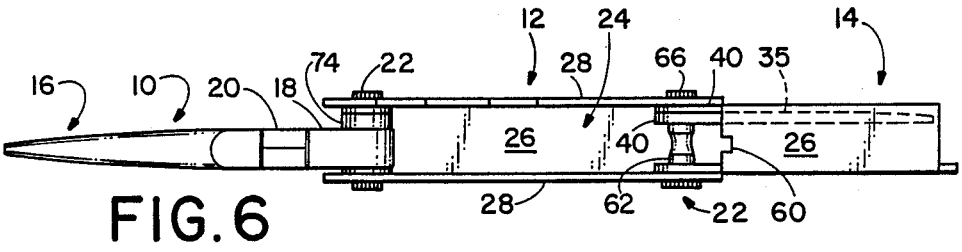
FIG. 6
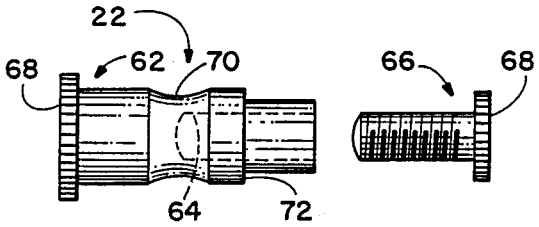
FIG. 11
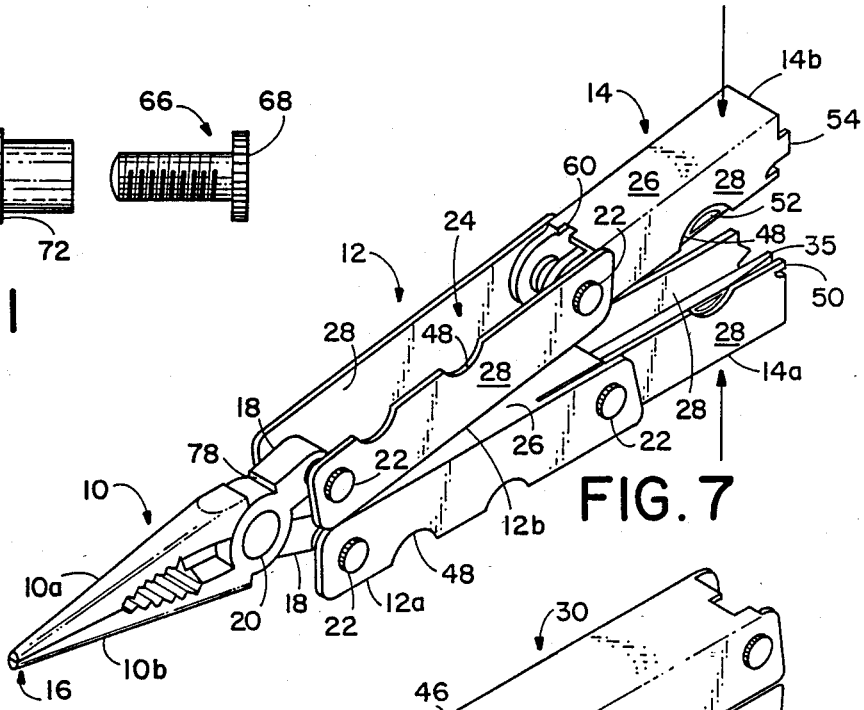
FIG. 7
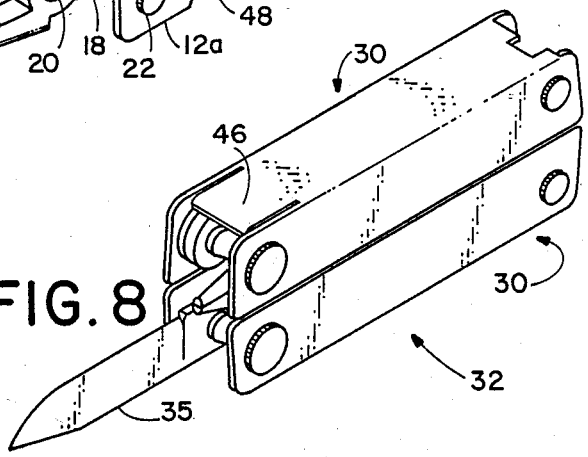
FIG. 8
FIG. 9
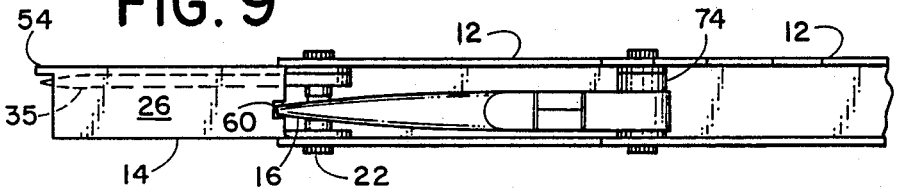
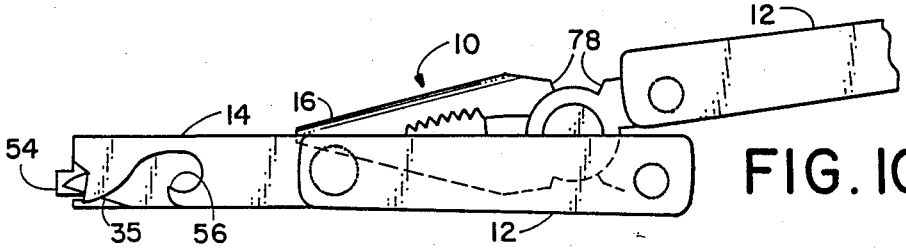
FIG. 10

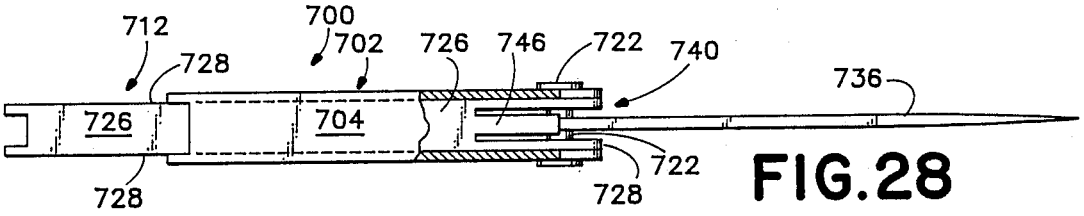
FIG.28
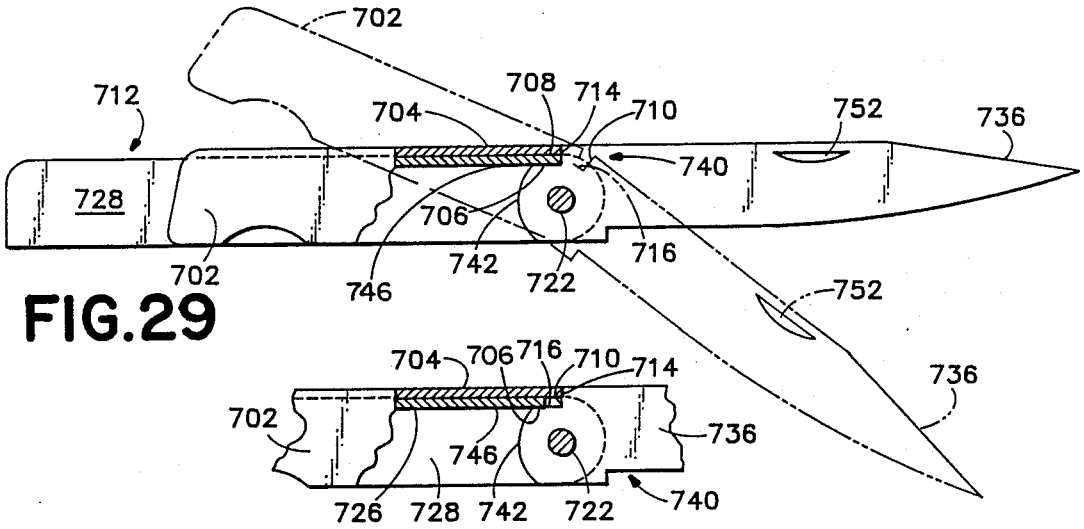
FIG.29
FIG. 30
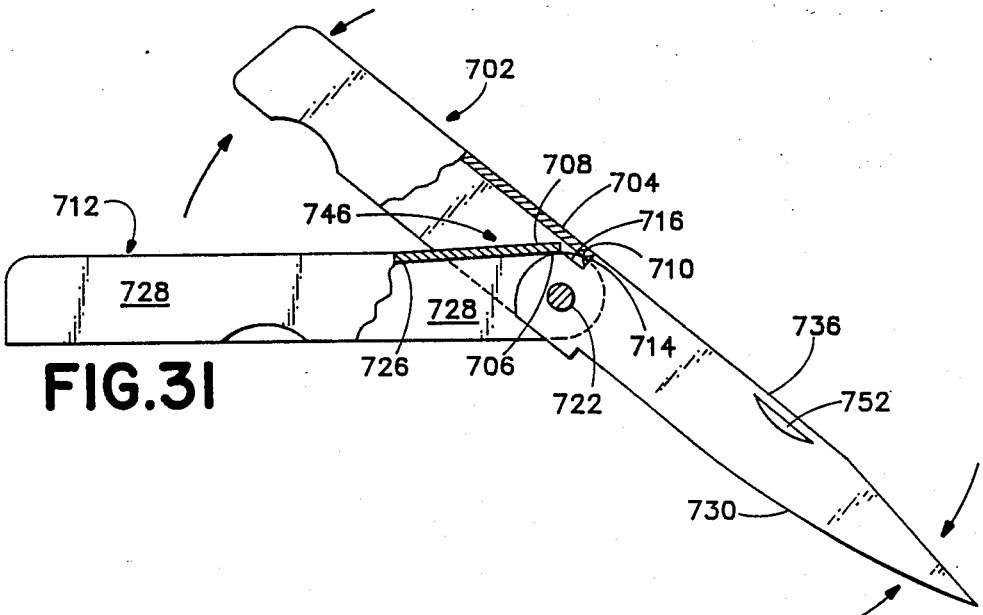
FIG.31
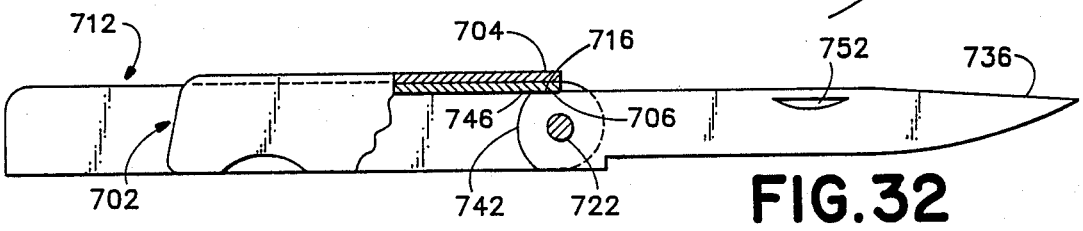
FIG.32

LOCK-BAR FOLDABLE TOOL

RELATION TO PRIOR APPLICATION

This application is a continuation-in-part of U.S. patent application Ser. No.853,349 filed Apr. 17, 1986 issued May 17, 1988 as U.S. Pat. No. 4,744,272.

BACKGROUND OF THE INVENTION

This invention relates to a foldable tool, and more particularly to such a tool having provisions for locking a folding tool blade into extended position with respect to the handle.

Leatherman, U.S. Pat. No. 4,238,862 and Brown, U.S. Pat. No. 1,486,725 show exemplary means for locking a folding tool blade into extended position with respect to a handle.

SUMMARY OF THE INVENTION

The present invention provides a folding tool having a handle and a tool blade pivotably connected to the handle. The handle includes a spring which resiliently bears against a cam surface on the base of the tool blade so that pivoting of the tool blade with respect to the handle deflects the spring. The tool includes operable locking means for selectively preventing the spring from deflecting, thereby locking the tool blade into extended position with respect to the handle.

According to the exemplary embodiments, a channel-shaped handle includes a spring in the web of the handle. A locking channel nests around the back of the handle and pivots about the same pin as the tool blade. When the blade is in extended position with respect to the handle, and the locking channel is nested with the handle, the web portion of the locking channel prevents the spring from deflecting, thereby locking the blade in extended position.

Accordingly, it is a principal object of the present invention to provide a folding tool which includes provisions for locking a tool blade into extended position with respect to a handle.

It is another object of the present invention to provide such a tool having a channel-shaped handle with a spring in the web of the handle.

It is a further object of the present invention to provide such a tool having a channel-shaped locking member which nests outside of a channel-shaped handle.

It is a related object of the present invention to provide such a tool having a safety shield for safely pivoting the tool blade into extended position.

It is a further object of the present invention to provide such a tool having multiple tool blades which may be locked into extended positions.

It is another object of the present invention to provide such a tool which permits a tool blade to be locked into a selected extended position with respect to the handle.

It is a further object of the present invention to provide such a tool having locking tool blades at both ends of the handle.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a side elevation view of an exemplary embodiment of the tool of the present invention showing how the components are foldable with respect to each other.

FIG. 2 is an end elevation view of the tool of FIG. 1 folded into a compact nested tool assembly.

FIG. 3 is an opposite side elevation view of the tool of FIG. 1 showing how the independent tool blades are foldable with respect to the handles.

FIG. 4 is an isometric view of the tool of FIG. 1 folded into a compact nested tool assembly.

FIG. 5 is a fragmentary sectional elevation view of the tool of FIG. 1 showing a handle and handle extension.

FIG. 6 is a plan view of the tool of FIG. 1 in fully extended position.

FIG. 7 is an isometric view of the tool of FIG. 1 in fully extended position.

FIG. 8 is an isometric view of the tool of FIG. 1 with a tool blade operatively extending from the compact nested tool assembly.

FIG. 9 is a plan view of the tool of FIG. 1 showing how the jaws be used to lock a handle extension into extended position.

FIG. 10 is a side elevation view of the tool shown in FIG. 9.

FIG. 11 is a side view of a disassembled pin assembly.

FIG. 12 is a side elevation view of the tool of FIG. 1 showing how the open jaws are received within the nested handle assemblies.

FIGS. 28–32 show exemplary embodiments of a lock-back folding knife, according to the present invention.

DETAILED DESCRIPTION OF THE INVENTION

Figure 13:
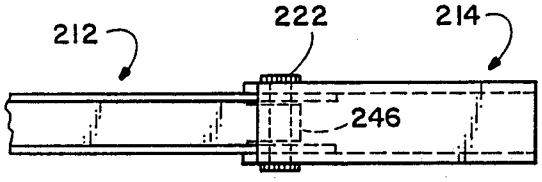
FIG. 13 is a fragmentary plan view of a handle and handle extension of an alternative embodiment of the tool of the present invention.

FIGS. 1–12 illustrate an exemplary embodiment of the foldable tool of the present invention having a pair of gripping cross jaws and compound folding handles. Referring particularly to FIG. 7, the tool shown in FIGS. 1–12 includes a pair of elongate gripping jaws 10, a pair of elongate handles 12, and a pair of elongate handle extensions 14. More specifically, the tool includes first and second curved elongate cross jaws 10*a* and 10*b*, respectively, each of the jaws including a nose 16 having a gripping portion, and a tang 18. The cross jaws are pivotally connected to each other by a bearing 20 intermediate the nose and tang. First and second elongate handles 12*a* and 12*b*, respectively, are attached to the respective first and second jaws by pins 22 which pivotally connect the inner ends of the handles to the tangs of the respective jaws. The handles are pivotable about the pins between extended and retracted positions with respect to the jaws. In a similar fashion, first and second elongate handle extensions, 14*a* and 14*b* respectively, are pivotally attached to the outer ends of the first and second handles by pins 22 and pivotable between extended and retracted positions with respect to their associated handles.

As may be seen in FIGS. 6 and 7, the handles and handle extensions are formed in the shape of elongate open channels 24 defined by a web 26 and two upstanding sidewalls 28. FIGS. 1 and 4 show that each of the handle extensions may be pivoted into nested handle assemblies 30—first and second nested handle assemblies 30*a* and 30*b*, respectively—with their associated handles. Each of the nested handle assemblies may be pivoted to enclose the cross jaws in a compact nested tool assembly 32, shown in FIG. 4, with the first jaw 10*a* received in an open channel of the second nested handle assembly 30*b*, and the second jaw 10*b* received within an open channel of the first nested handle assembly 30*a*.

Note that the elongate handle extensions are substantially coaxial with their respective elongate handles when configured in nested handle assemblies therewith and that the nested handle assemblies are substantially coaxial with an axis 34, shown in FIG. 1, of the nose of the opposite cross jaw when the tool is folded into the compact nested tool assembly 32 shown in FIG. 4. Note also that the nested tool assembly is compact, substantially defined by the two handles arranged closely adjacent each other with their respective axes parallel.

A stop 99, shown in FIG. 12, cooperates between the tangs of the cross jaws and their respective handles to prevent further pivoting of the handles with respect to the jaws once they have reached the extended position shown in FIGS. 1, 3 and 7, with the outer ends of the handles spread apart. In a similar fashion, a stop, shown in FIG. 5, cooperates between the handle extensions and their respective handles to prevent further pivoting of the handle extensions with respect to the handles once they have reached the extended position shown in FIGS. 1 and 7.

When the tool is fully unfolded into extended position as shown in FIG. 7, the stops described above cooperate with their associated jaws, handles and handle extensions to allow the gripping portions of the jaws to be forced together when the spread apart handle extensions are urged toward each other as represented by the large dark arrows in FIG. 7. Note that the respective webs 26 of the handle extensions provide broad, smooth force-receiving surfaces to permit the user of this tool to comfortably squeeze the handle extensions together to apply considerable force to the gripping jaws when using this tool. It will be recalled that the prior art folding pliers did not have such broad, smooth, force-receiving surfaces.

Referring to FIG. 5, the base 40 of the handle extension includes a curved cam surface 42 and a notched seat 44. The web 26 proximate the outer end of the handle incorporates an integral spring 46 which is bent downwardly into the open channel, extending between the upstanding side walls 28 of the handle. When the handle extension is pivoted between nested and extended positions, the cam surface causes the spring to deflect and provide a frictional resistance to prevent the handle extension from freely pivoting, or flopping, about the pin. As the handle extension is pivoted into extended position, the spring drops into the notched seat formed in the base of the handle extension and resiliently locks the handle extension into extended position, the edge of the spring abutting against a wall of the notched seat and acting as a stop to prevent further pivoting of the handle extension. It should be noted that when the handle extension is in the extended position shown in FIG. 5 with the spring seated in the notched seat, the spring exerts a force on the edge of the notched seat which resiliently retains the handle extension in the extended position. This force is sufficient to permit the jaws of the tool to be opened by urging the handle extensions apart.

Referring to FIG. 3, the exemplary tool of the present invention includes elongate tool blades 35, in this case a knife blade 36 and a combination screwdriver/file 38, each tool blade pivotally connected to the outer end of one of the handles by the same pin 22 which pivotally attaches the respective handle extension. Of course, it should be understood that the choice of the tool blades is arbitary and that other types of blades, such as an awl, could be substituted for those shown herein. Like the handle extensions, the tool blades pivot between extended and retracted, or nested positions with respect to their associated handles. Note that like the handle extensions, the elongate tool blades are substantially coaxial with their respective elongate handles and handle extensions in both extended and nested positions.

Each of the tool blades also includes a base 40, cam surface 42, and notched seat 44 substantially identical to those features described above and shown in FIG. 5 with respect to the handle extension. The spring 46 cooperates with the notched seat of the handle extension to stop and resiliently lock the tool blade in extended position. As explained in the following paragraphs the tool blades may be pivoted into extended position either simultaneously with, or independently of, the handle extensions.

As shown in FIG. 1, since the tool blades are received in the open channels 24 of the handle extensions, the tool blades may be pivoted into extended position with respect to the handles by manipulating the handle extensions. Referring to FIG. 3, each of the handles include a curved recess 48 in one of the sidewalls thereof. The handle extensions each include a finger 50 which is aligned with the curved recess of its respective handle when the handle extensions are nested in the open channels of their respective handles, with the finger of the handle extension adjacent to the curved recess of the handle. The curved recess and finger provide a convenient way to engage the handle extension with a fingernail and pivot the handle extension and associated tool blade out of the open channel of the handle.

Once the handle extension and associated tool blade are in extended position with respect to their handle, the resistive force of the spring upon the substantially identical curved cam surface of the tool blade permits the tool blade to be retained in extended position while the handle extension is pivoted back into nested relationship with its respective handle. Alternatively, a tool blade may be pivoted into extended position independently of its handle extension by engaging the nail nick 52 on the tool blade which is accessed through corresponding curved recesses 48 on the handles, as shown in FIG. 3, and on the handle extensions as shown in FIG. 7.

The tool blade may be returned to nested relationship with its respective handle either by pivoting it about the pin 22 as shown in FIG. 3, or by repositioning the handle extension into extended position, and then pivoting both handle extension and associated tool blade into the open channel of the handle. The advantage of the latter method is that during manipulation the tool blade is shielded within the open channel of the handle extension as shown in FIGS. 1 and 5, preventing injury to the user.

FIG. 8 illustrates the preferred configuration for using the tool blades of the tool, with the remainder of the tool folded into the compact nested tool assembly 32, which provides a convenient and comfortable handle for grasping the tool and manipulating the tool blade. Using the tool as shown in FIG. 8 also prevents the tool blade from pivoting back toward the retracted or nested position and cutting the user's hand in a manner common to folding pocket knives. As shown in FIG. 8, the upper nested handle assembly 30 prevents the tool blade from pivoting into contact with the user's hand, which would be gripping the entire compact nested tool assembly.

From the drawings it will be apparent that the handle extensions also include integral tool blade components such as a screwdriver tip 54, a can/bottle opener 56, and a partial Phillips head tool 58. As pointed out above, choice of the particular types of tools is arbitrary. When using the tool blade components integral to the handle extensions it is possible to positively lock the handle extensions into extended position. Referring to FIGS. 9 and 10, a portion of the web 26 of which is proximate the pin includes a pocket 60 formed therein. When the handle extension is in extended position, the jaws may be folded into retracted position with respect to the handle which is connected to the extended handle extension. The nose 16 of the jaws are received in the pocket, thereby preventing the handle extension from pivoting back toward its respective handle. For clarity, FIGS. 9 and 10 show the opposite handle in extended position with respect to the jaws. However, it should be recognized that the opposite handle could be pivoted into the compact nested tool assembly shown in FIG. 8 with the handle extension including the tool blade component extending from the compact nested tool assembly.

As previously explained, the spring 46 integral with the web 26 of the handle is bent downwardly into the open channel extending between the sidewalls. There are two important reasons for the bent spring. First, as referred to above, the bent spring provides a line of force on the notched seat of the cam when the handle extension or tool blade is in extended position, providing more positive resilient locking force than could be achieved with a straight spring such as used with the prior art folding tool. Secondly, because the handle extensions must nest flush within the open channels of the handles, it follows that the sidewalls of the handle extensions are shorter than the sidewalls of the handles. As a consequence, when the handle extensions are pivoted into extended position as shown in FIG. 1, the webs of the handle extensions would not be flush with the tops of the sidewalls of their associated handles. This discrepancy could cause discomfort to the user when applying squeezing force to the handle extensions proximate the outer ends of the handles. However, the downwardly bent spring allows the handle extension to be pivoted to an extended position substantially coaxial with its associated handle, with the web of the handle extension flush with the top of the sidewalls of the handle for a comfortable grip.

FIG. 11 shows a pin assembly 22 of the type used to pivotally connect the handle extensions and tool blades to the outer ends of their respective handles. The pin assembly includes a cylindrical post 62 having a threaded recess 64 for receiving a cylindrical threaded screw 66. Both post and screw have knurled heads 68 with approximately 35 teeth per inch. When the tool is assembled, the screw is engaged in the threaded recess and may be tightened to specifications by a special tool which engages the knurled heads of the post and screw. It will be appreciated that proper tightening of the screw in the threaded recess is important to prevent the pivotable components of the tool from being either too tightly or too loosely connected to each other.

Note that the post 62 has a groove 70 formed circumferentially therein. As may be seen in FIGS. 2, 9 and 10, the groove permits the tool to employ long, needle-nose type jaws, yet be capable of folding into a compact nested tool assembly by receiving the nose of the jaws in the groove.

Note also that the pin includes a shoulder 72 where the radius of the post abruptly decreases. When the tool is assembled, the shoulder of the pin is arranged adjacent the base 40 of a tool blade 35 and serves to stabilize the tool blade. Referring to FIG. 6 it will be understood that as the screw is tightened within the threaded recess of the post, the base of the tool blade is securely pinched between the adjacent base of the handle extension and the shoulder of the pin, which cooperate to provide good lateral support for the tool blade. Of course, it will be understood that alternative embodiments which employ a washer or sleeve to pinch the base of the tool blade against the handle extension are within the scope of the present invention.

The pins 22 which pivotally connect the inner ends of the handles to the jaws are similar to the pins described above in that they include a post with a threaded recess and a screw, both post and screw having knurled heads. However, the jaw pins have no need for the circumferential groove described above. Referring again to FIG. 6, it will be seen that it is advantageous to provide some type of abutment, either a washer 74 as shown in FIG. 6, or a shoulder on the pin as described above, in order to laterally stabilize the jaws.

FIG. 12 shows the exemplary embodiment in an open nested assembly configuration with the jaws of the tool opened to their fullest extent. As may be seen more readily in FIGS. 1, 3, 7 and 10, each of the cross jaws include a pair of shoulder stops 78 on the back of the jaw and on the tang. Each shoulder stop cooperates with a shoulder stop of the cross jaw in a manner shown in FIG. 12 to limit the pivoting of the cross jaws with respect to each other, thereby limiting the opening of the jaws. It should be noted that when the jaws are opened to their fullest extent with the jaws nested within the handles, the tip of the needle-type nose 16 of the jaws rests in the groove 70 of the pin 22. It will be seen that as the jaws are pivoted about the bearing 20 to close the jaws, the jaws and bearing will move toward the outer ends of the handles. If the nose did not overlap the pin, the needle-type nose of the jaws could become lodged beneath the pin when the tool is squeezed together from the open nested assembly configuration shown in FIG. 12 to the closed, compact nested tool assembly shown in FIG. 4.

FIGS. 13–27 show alternative features or embodiments not described above with respect to the exemplary embodiment. Most of FIGS. 13–27 relate to embodiments of a foldable tool with compound folding handles having an outside handle extension configuration wherein the handles are nested within the open channels of the handle extensions.

Figure 14:
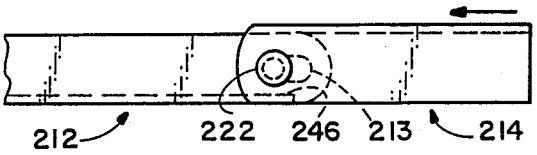
FIG. 14 is a side elevation view of the tool shown in FIG. 13.
Figure 15:
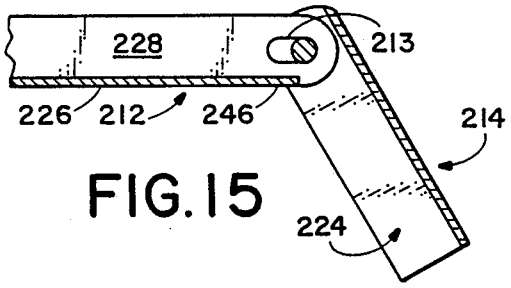
FIG. 15 is a fragmentary sectional elevation view of the embodiment shown in FIG. 13 showing how the handle extension with respect to the handle.

Referring particularly to FIGS. 13–15, handle 212 includes a slot 213 in the sidewalls 228 thereof. A pin 222 pivotally connects the handle extension 214 to the outer end of the handle. Like the exemplary embodiment described above, the handle extension is pivotable between extended and retracted, nested positions with respect to the handle, except in this embodiment the handle extension nests outside of the handle, with the handle received within the open channel 224 of the handle extension.

The handle extension is locked into extended position by sliding the handle extension inwardly toward the inner end of the handle as shown in FIGS. 13 and 14, thereby moving the pin to the inner end of the slot. In FIG. 14, with the pin at the outer end of the slot, the handle extension may be pivoted between extended and nested positions. However, when the handle extension and pin are moved inwardly from the outer end of the handle, thereby moving the rotational axis of the pin inwardly, the handle extension is too far overlapping the outer end of the handle to pivot about the pin.

With reference to FIG. 7, it will be readily understood that when the handle extensions are locked into extended position as shown in FIGS. 13 and 14, the handle extensions may be manually squeezed together to urge the jaws of the tool together or urged apart to spread the jaws apart. It should also be pointed out that the embodiment shown in FIGS. 13–15 will also form a compact nested assembly similar to that shown in FIG. 4, except that the handle extensions will be nested outside of the handles.

Figure 16:
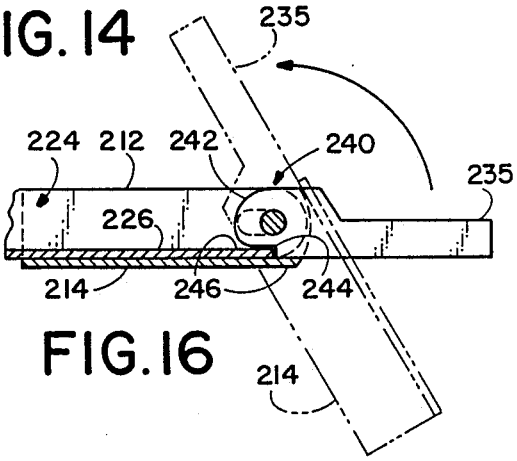
FIG. 16 is a fragmentary sectional elevation view of the embodiment shown in FIG. 13 including an independent tool blade interacting with the handle extension.

The embodiment shown in FIGS. 13–16, like the previously described embodiment, includes an integral spring 246 in the web 226 of the handle proximate the outer end of the handle. FIG. 16 shows this embodiment having a tool blade 235 pivotable about the pin 222 between an extended position and a retracted, nested position, wherein the tool blade is received within the open channel 224 of the handle. Note that unlike the spring 46 of the exemplary embodiment, the spring 246 shown in FIGS. 13–16 is not bent downwardly between the sidewalls of the handle.

As explained above with respect to the exemplary embodiment, the tool blade includes a base 240 with a cam surface 242 and a notched seat 244 similar to that described with respect to the exemplary embodiment. When the tool blade is pivoted between extended and nested positions, the cam surface of the base of the tool blade causes the spring 246 to deflect. When the tool blade is in extended position, the spring abuts the wall of the notched seat 244 in the manner shown in FIG. 16 and prevents further rotation of the tool blade beyond the extended position.

The tool blade is pivoted and locked in the extended position shown in FIG. 16 by simultaneously pivoting the handle extension into nested relationship with the handle. With the handle extension in nested position, the web of the handle extension lies closely adjacent the web of the handle and prevents the spring 246 from deflecting, thereby preventing the tool blade from pivoting.

It should be noted that the embodiments shown in FIGS. 17–20 and 25–27, all having an outside handle extension configuration, include the locking feature for the tool blade described above, wherein the handle extension, in nested position, prevents the spring from deflecting, thereby locking the tool blade in extended position.

Applicant believes that this feature of the present invention could be applied to other folding tools by providing a similar spring and an operable locking mechanism to selectively prevent the spring from deflecting, and accordingly does not intend to limit application of this feature to a foldable gripping tool having handle extensions.

Prior to describing the exemplary lock-back tools shown in FIGS. 28–36, reference is made to FIGS. 1, 3, 5, 13–20 and 24–27, and particularly to FIG. 16 and to pages 15–18 describing the lock-back feature with respect to a foldable tool. Regarding FIG. 16, it should be pointed out that the slot in the handle 212 (the slot is shown as 213 in FIG. 15) is to lock the handle extension 214 into extended position with respect to the handle 212 and does not form a part of the lock-back invention described below.

FIGS. 28 and 29 show an exemplary lock-back knife 700 including a handle 712 and a knife blade 736 pivotally attached to the handle by a pin 722. The handle is channel shaped having a pair of opposed sidewalls 728 interconnected by a web 726. The web 726 of the handle includes an integral spring 746. The base 740 of the blade includes a cam surface 742, the spring resiliently bearing against the cam surface on the base of the blade.

The lock-back knife includes a locking channel 702 also pivotally connected to the handle by the pin. The locking channel is adapted to fit around the back of the handle in nested relationship therewith. When nested around the handle, the web portion 704 of the locking channel fits closely over the spring 746, preventing the spring from deflecting and thereby preventing the blade from rotating. In FIG. 28, a portion of the web 704 of the locking channel 702 has been broken away to show the underlying spring 746 and web portion 726 of the handle 712. In FIG. 29, a portion of the sidewalls of both the locking channel and the handle have been broken away to show the spring 746 bearing against the cam surface 742 on the base 740 of the blade, and to show the web portion 704 of the locking channel positioned on top of the spring to prevent it from deflecting.

Interaction of the cam surface 742, spring 746, and locking channel 702 will be apparent from FIG. 31 and the following description. From the locked position shown in FIG. 29, the blade 736 pivots clockwise about the pin 722, the cam surface 742 pressing upwardly against the adjacent inner surface 706 of the spring causing the spring to deflect upwardly. Such movement of the spring and blade is permitted as the locking channel is pivoted to an "unlocked" position shown in FIG. 31.

However, when the locking channel is pivoted into a "locked" or nested position as shown in FIG. 29, the web portion 704 of the locking channel lies over the outer surface 708 of the spring proximate the cam surface on the base of the blade and prevents upward deflection of the spring, thereby locking the blade into extended position.

Referring to the exemplary embodiments shown in FIGS. 29, 30, and 31, the back of the blade proximate the base includes a step 710 which, in cooperation with the edge 714 of the locking channel or spring, or both, acts as a stop to prevent further rotation of the blade with respect to the handle. FIG. 16 shows abutment of the step against the edge of the spring. FIG. 30 shows abutment of the step against the edge of the locking channel, and FIG. 29 shows abutment of the step against the edges of both the spring and locking channel. As shown in FIG. 31, when the step 710 in the back of the knife blade abuts the edge 714 of the locking channel, manipulation of the locking channel may be used to unlock the blade and pivot the blade toward a closed or nested position without the need to manipulate the blade itself.

From the foregoing explanation concerning the cooperation of spring, blade, locking channel, and step, it will be appreciated that when the blade is in extended position as shown in FIGS. 29 and 30 it is securely locked: the cooperation of locking channel, spring and cam surface preventing rotation of the blade about the pin in a clockwise direction, and the cooperation of the edge 714 of the locking channel and the step 710 of the blade preventing rotation of the blade about the pin in a counterclockwise direction.

Turning to FIG. 32, another exemplary embodiment of the lock-back knife is shown with a portion of the sidewalls of the locking channel and handle broken away to show the relative operative relationship between the cam surface on the base of the blade and the spring. As in the exemplary embodiments shown in FIGS. 28–31, the cam surface 742 on the base of the blade includes a flat portion 716 where the inner surface 706 of the spring rests when the blade is locked in extended position. The exemplary embodiment shown in FIG. 32 does not include a step in the base of the blade to prevent counterclockwise rotation of the blade about the pin. However, careful study of FIG. 32 will reveal that the cooperation of the flat portion 716 of the cam surface, the spring, and the locking channel will prevent counterclockwise rotation of the blade by preventing deflection of the spring since deflection of the spring is necessary for counterclockwise rotation.

Figure 33:
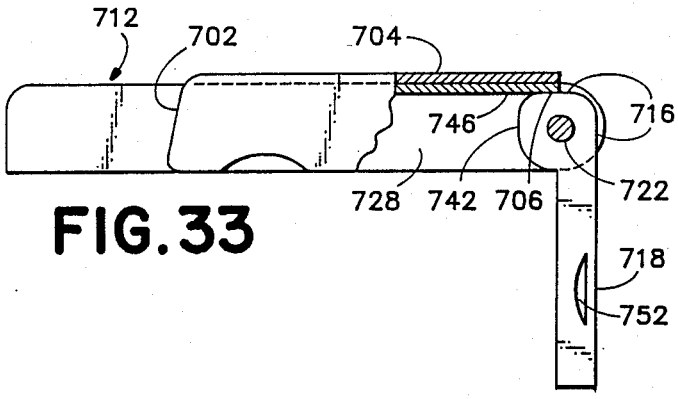
FIG. 33 is a further exemplary embodiment of the present invention showing a folding tool blade locked into extended position perpendicular to the handle.

Turning to FIG. 33, a further embodiment of the present invention is shown having a tool blade such as a screwdriver blade 718 which may be locked into an extended position substantially perpendicular to the handle. In FIG. 33, a portion of the locking channel and handle have been broken away to show the details of the cam surface 742 and its cooperation with the spring 746. Note that the cam surface 742 at the base of the screwdriver blade includes two flat portions 716 so that the screwdriver blade may be selectively locked into extended position parallel or perpendicular to the handle. Of course, it will be understood that the number and position of flat portions on the cam surface are design choices within the scope of this invention.

Moreover, it should be pointed out that while flat portions on the cam surface are desirable, they are not strictly necessary for operation of the invention disclosed herein. The locking channel can be used to forcefully clamp the spring against the cam surface, locking the blade into extended position by enhanced frictional engagement between the spring and the cam surface. Also, the cam may be shaped without flat portions, but the base of the blade configured so that rotation of the blade tends to deflect the spring during opening and closing. To ensure that the blade securely locks into extended position, it is preferable that the spring contacts two spaced-apart points on the base of the blade when in locked position.

Figure 34:
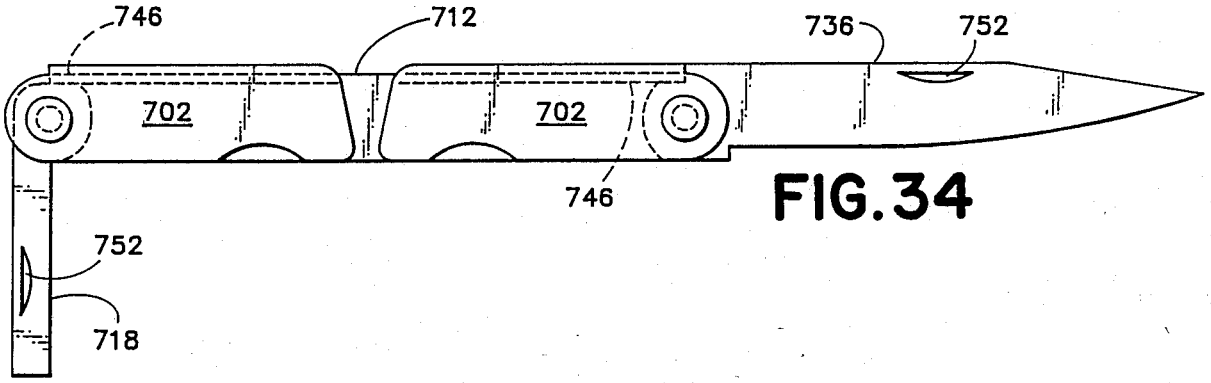
FIG. 34 is a further exemplary embodiment of the present invention showing locking tool blades at both ends of a handle.

Another embodiment of the present invention is shown in FIG. 34 comprising a lock-back tool with a knife blade 736 at one end of the handle and a screwdriver blade 718 at the other end of the handle, each end including a spring 746 and a locking channel 702.

As described above with respect to FIG. 16, the blade of the exemplary lock-back knife may be pivoted into extended position, and locked in that position, by simultaneously pivoting the locking channel into locked, nested position so that the blade achieves extended position when the locking channel achieves locked position. This technique is best illustrated by FIG. 31, which shows the blade and locking channel arranged substantially coaxial with each other on opposite sides of the pin 722. With the step 710 in the blade cooperating with the edge 714 of the locking channel, the blade may be pivoted and locked into position by counterclockwise manipulation of the blade alone, interaction of the step 710 and edge 714 acting to pivot the locking channel about the pin.

However, a problem with this method is that the blade must be pulled counterclockwise by the nail nick 752 or by gripping the sides of the blade, or pushed counterclockwise by applying a force to the sharp side 730 of the blade. None of these alternatives is entirely safe or desirable, so applicant has devised a further embodiment of the lock-back knife having a safety shield 720 as shown in FIGS. 35 and 36 and also as described above with respect to FIG. 3.

Figure 35:
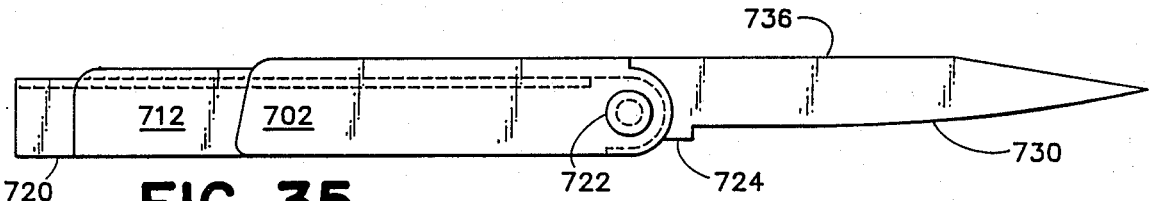
FIGS. 35 and 36 show a further exemplary embodiment of a lock-back knife such as shown in FIGS. 28–32 including a folding safety shield.
Figure 36:
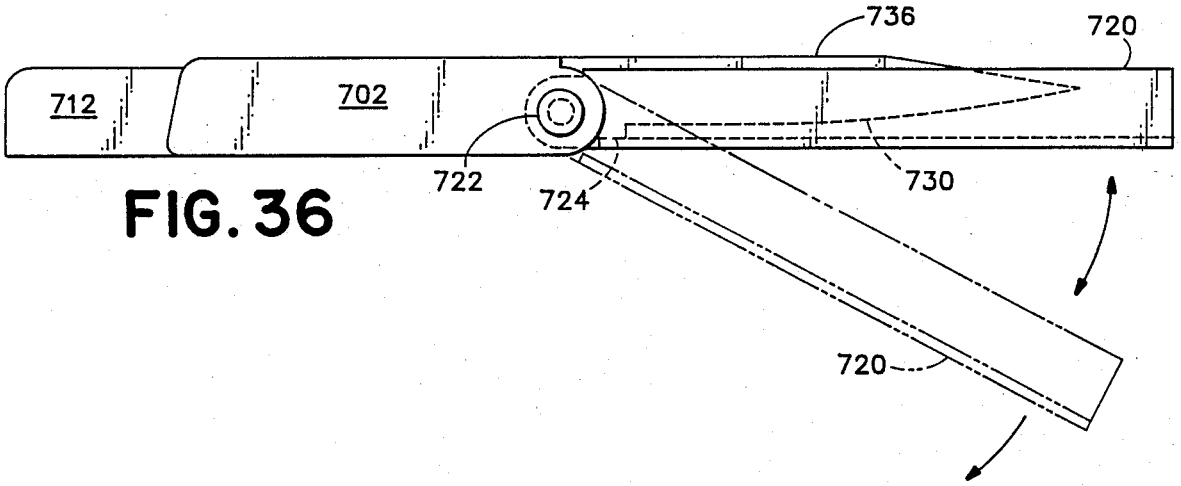

The exemplary safety shield is also channel-shaped to receive the blade 736 therein as shown in FIG. 36, and pivots about the pin 722 between extended position shown in FIG. 36 and the nested position shown in FIG. 35, with the safety shield received within the channel-shaped handle and extending slightly beyond the end of the handle. It should be noted that a safety shield as shown and described herein could be used with a variety of folding tools and is not limited to use with the exemplary tools shown herein.

Note that the blade includes a kick 724 near the base thereof. As may be seen in FIG. 36, the web of the channel shaped safety shield rotates against the kick 724 so that counterclockwise rotation of the safety shield alone rotates the blade into extended position without contact between the sharp edge 730 of the blade and the safety shield, which contact would dull the sharp edge of the blade.

Recalling the earlier description of how the blade alone may be manipulated to rotate the blade and locking channel into locked position, it will be understood that the safety shield alone may be manipulated to rotate the safety shield, blade and locking channel into locked position. Once the blade is in extended locked position, the safety shield may be pivoted back to nested position within the handle. Provision of the safety shield in the exemplary embodiments eliminates the need for a nail nick 752 shown in other embodiments. A safety shield which extends beyond the end of the channel-shaped handle as shown in FIG. 35 also increases the leverage available for opening the blade against the resistance due to side pressure on the blade, interferences due to manufacturing tolerances, and against resistance of the spring, enabling a more powerful spring to be used.

In the exemplary embodiments shown in FIGS. 28–36 the lock-back tool has been shown with a locking channel which pivots about the pin. The present invention should not be limited to such a configuration, other locking members which would function to prevent deflection of the spring 746 are also contemplated. For example, the locking member may slide into position over the spring to prevent deflection of the spring. Other locking members may comprise straps, yokes, or loops which pivot or slide into position on top of the spring.

Figure 24:
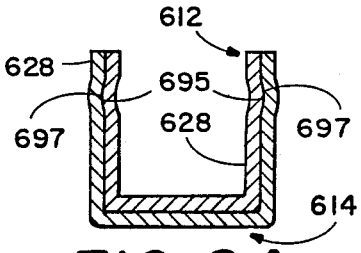
FIG. 24 is an end sectional view showing a handle nested in the open channel of a handle extension.

Whatever type of locking member is used, it is contemplated that a second locking mechanism, such as a button, catch, or loop, may be used to retain the locking member in locked position. Another exemplary locking mechanism is shown in FIG. 24 and described below. In the exemplary embodiments the user's hand would tend to keep the locking channel in locked position.

Although the exemplary embodiments have been depicted and described with a single tool blade pivoting about the pin at one end of the handle, applicant envisions embodiments which have more than one tool blade at one end of the handle. For example, in the exemplary tool shown in FIG. 28, tool blades may be positioned on both sides of the knife blade. The respective bases of such tool blades would serve to act as spacers between the base of the knife blade and the side walls 728 of the handle to brace the knife blade against side play due to side pressure on the knife blade. The knife blade may also be braced against side play by arranging the sidewalls of the handle closely adjacent the base of the blade, or by washers or the like between the base of the blade and the sidewalls of the handle. Of course, when multiple tool blades are arranged at one end of the handle, safety shields may be used with some or all of the blades.

Although the exemplary embodiments show an integral channel-shaped handle, with an integral spring, it should be understood that alternative embodiments need not employ an integral handle or even a spring which is integral with the handle.

Figure 17:
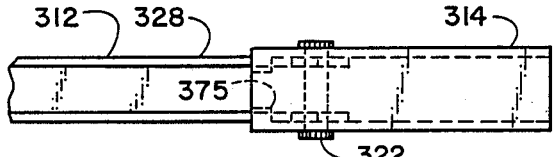
FIGS. 17–20 are views of a further embodiment of the present invention which correspond to the views of FIGS. 13–16, respectively.
Figure 18:
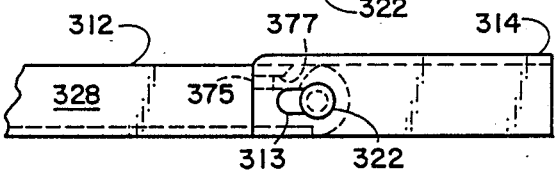
Figure 19:
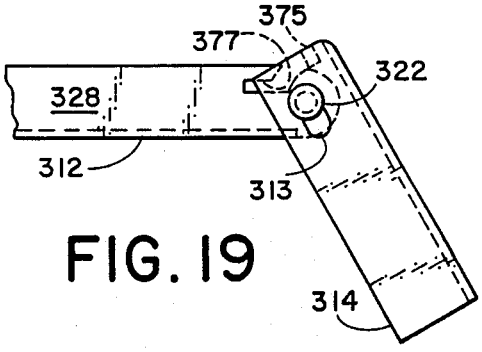

Turning now to FIGS. 17–20, the handle extension 314 is again pivotally connected to the outer end of the handle 312 by a pin 322, and is pivotable between an extended position shown in FIGS. 17 and 18 and a retracted, nested position. However, in this embodiment the slot 313 is formed in the handle extension, rather than the handle. The inner end of the handle extension, inwardly of the slot, includes an opposed pair of short arms 375 extending into the open channel which defines the handle extension. The sidewalls 328 of the handle include a pair of opposed niches 377 adapted and arranged to receive the arms of the handle extension when the handle extension is slid inwardly with respect to the handle and pin to the position shown in FIGS. 17 and 18, with the pin at the outer end of the slot 313. In this manner the handle extensions are locked in extended position with respect to the handles so that the handle extensions may be grasped and squeezed together in order to urge the jaws of the tool together or spread apart to urge the jaws apart.

Figure 20:
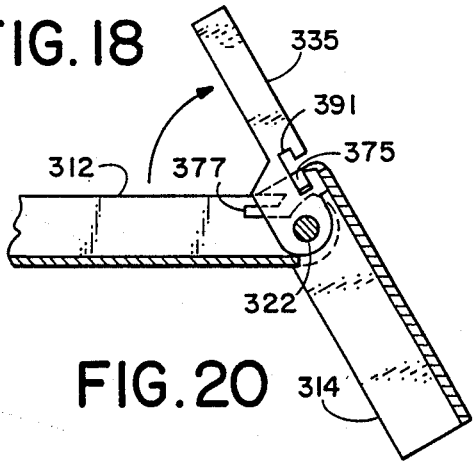

As shown in FIG. 20, the tool blade 335 of this embodiment includes a T slot 391 formed near the base of the tool. The cross member of the T slot permits one of the arms 375 of the handle extension to slide back and forth in the T slot as the handle extension is slid back and forth with respect to the handle. When the handle extension is in the outermost position with respect to the handle, the arm 375 of the handle extension engages a portion of the T slot in the tool blade, as shown in FIG. 20, and the tool blade may be pivoted out of nested position and into extended position by pivoting the handle extension toward its nested position thus allowing the tool blade to be folded open without using a fingernail nick.

Figure 25:
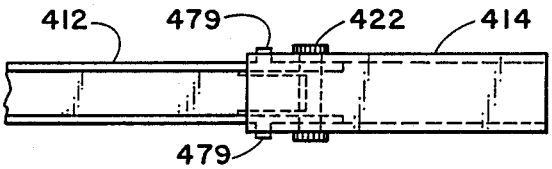
FIGS. 25–27 are views of a further embodiment of the present invention which correspond to the views of FIGS. 13–15, respectively.
Figure 26:
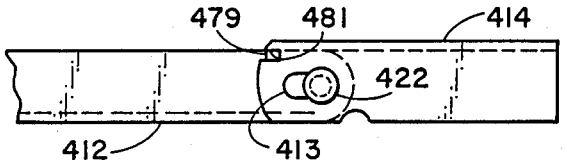
Figure 27:
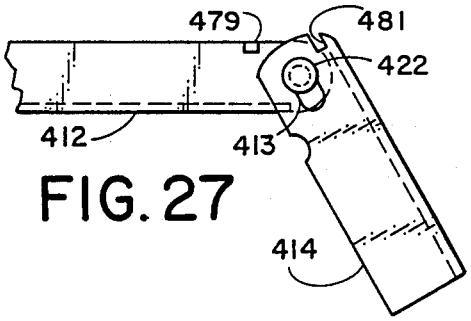

FIGS. 25–27 show another embodiment having an outside handle extension configuration similar to that shown in FIGS. 17–20, except that the handle sidewalls include a pair of projecting ears 479 which are received in sockets 481 in the handle extension sidewalls when the handle extension is slid inwardly with respect to the pin 422 and handle 412. The engagement of the ears 479 in their respective sockets 481 locks the handle extensions in extended position and permits the handle extensions to be grasped and squeezed together to urge the jaws of the tool together or urged apart to spread the jaws apart.

Figure 21:
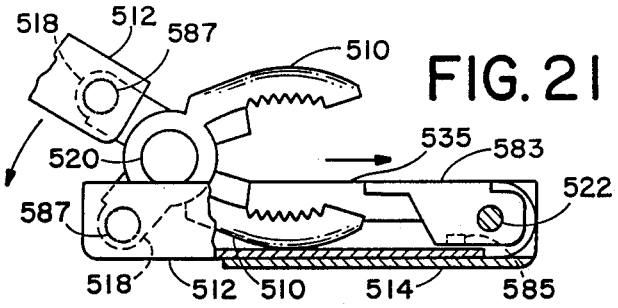
FIG. 21 is partial sectional view of another embodiment of the tool of the present invention having a tool blade lifter.
Figure 22:
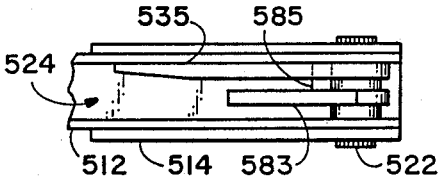
FIG. 22 is a partial plan view of the tool shown in FIG. 21.
Figure 23:
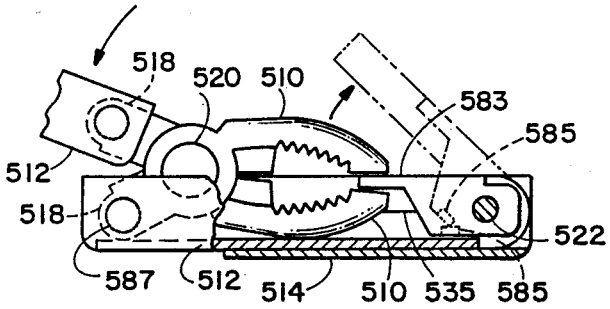
FIG. 23 is a partial sectional view of the tool shown in FIG. 21 showing operation of the tool blade lifter.

FIGS. 21–23 show another embodiment of the present invention wherein the gripping jaws 510 of the tool may be used to pivot the tool blade 535 out of nested position within the handle 512. Referring to FIG. 22, a lifer 583 is pivotally connected to the outer end of the handle by the pin 522, and pivotable between extended and retracted, nested positions with respect to the handle. The lifter includes a tab 585 which extends beneath the base of the tool blade.

It will be recalled that each of the jaws is pivotally connected to a handle by pins, more specifically jaw pins 587 cooperating between the tangs 518 of the jaws and the inner ends of the handles 512. It should also be recalled that the jaws are pivotally connected to each other by a bearing 520 intermediate the nose of the jaws and the tangs. Referring to FIGS. 21 and 23, it will be understood that when the upper tang, which is associated with the lower jaw, is brought toward the lower tang, which is associated with the upper jaw, the lower jaw will pivot about the bearing and the upper jaw will pivot about the lower pin causing the bearing and the jaws to move toward the outer end of the handle. This movement of the jaws positions the nose of the lower jaw beneath the lifter. Further downward pressure on the upper tang causes both jaws to pivot about the lower pin 587 lifting the nose of the jaws, the lifter, and the tool blade out of the open channel of the handle. Once the tool blade is pivoted out of the channel of the handle, as shown in FIG. 23, the tool blade may be pivoted into extended position and the lifter returned to nested position.

All of the embodiments employing the outside handle extension configuration need some device to prevent the handle extensions from freely pivoting, or flopping, between nested and extended positions. As shown in FIG. 24, one method of retaining the handle extension in nested position with respect to its handle is to form a dimple 695 on the sidewalls 628 of one member and corresponding projections 697 on the sidewalls 628 of the other member so that the projection will seat in the dimple and retain the handle extension in nested position with respect to the handle. Another method, not shown, is to pinch the sidewalls of the handle extension inwardly toward the sidewalls of the handle so as to frictionally engage the sidewalls of the handle.

Applicant does not intend the present invention to be limited to the specific embodiments described above and shown in the accompanying drawings. For example, although only one tool blade is shown in association with each handle, it should be clear that embodiments which employ more than one tool blade in association with a handle are within the scope of the invention. Similarly, although the exemplary embodiment shown in FIGS. 1–12 positions a handle extension within the open channel of a handle and a tool blade within the open channel of the handle extension, it is contemplated that the handle extension and tool blade could be arranged adjacent to each other in the open channel of the handle.

Other alternative embodiments considered to be within the contemplation of the invention include an extensible channel shaped handle extension which slides, rather than pivots, with respect to its associated handle, yet in retracted position is capable of forming a nested handle assembly with its handle and enclosing the gripping jaws or other tool head.

Indeed, this invention should not be limited to an embodiment including gripping cross jaws, but could be applied to any foldable tool having a tool head and compound folding handle assemblies which may be folded into a compact nested assembly with the tool head enclosed by the nested handle assemblies.

It should also be noted that the method for locking the handle extension into extended position shown in FIGS. 9 and 10, may be accomplished in other ways, not specifically shown or described, but within the concept of the present invention. For example, a pawl could be used rather than the jaws to engage the pocket 60 and lock a handle extension, or other extensible tool, into extended position.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A foldable tool comprising:

(a) an elongate handle having a length greater than its width and its depth;

(b) at least one tool blade pivotally connected to said handle and pivotable thereto between extended and retracted positions, said tool blade having a base approximate said handle;

(c) said handle including spring means resiliently bearing against said base for deflecting to permit said tool blade to be pivoted between said extended and retracted positions;

(d) operable locking means for selectively preventing said spring means from deflecting; and (e) said locking means including an elongate channel having a length greater than its width and its depth pivoted to said handle to receive a portion of said handle in said channel when in a nested, locked position so that said length of said channel extends along said length of said handle so as to form therewith handle means for grasping said tool.

2. The tool of claim 1 wherein said base of said blade includes stop means for limiting the pivotal movement of said blade with respect to said handle.

3. The tool of claim 1 wherein said handle includes abutment means for cooperating with said stop means to limit pivotal movement of said blade with respect to said handle.

4. The tool of claim 1 wherein said base of said blade includes a cam surface including one or more substantially flat portions.

5. The tool of claim 4 wherein said tool blade is substantially elongate, said cam surface including a substantially flat portion arranged substantially perpendicular to said tool blade.

6. The tool blade of claim 4 wherein said tool blade is substantially elongate, said cam surface including a substantially flat portion arranged substantially parallel to said tool blade.

7. The tool of claim 1 including safety shield means for safely pivoting said tool blade to an extended position with respect to said handle.

8. The tool of claim 7 wherein said blade is pivotally connected to said handle by a pin, said safety shield also pivotally connected to said handle by said pin.

9. The tool of claim 1 wherein said spring means and said base of said blade cooperate as means for enabling said blade to be locked into two or more extended positions with respect to said handle.

10. The tool of claim 1 wherein said handle has a first end, said tool blade pivotally connected to said first end, said tool including at least one additional tool blade pivotally connected to said first end.

11. The tool of claim 1 wherein said spring means and said base of said blade cooperate to limit pivotal movement of said blade with respect to said handle.

12. A foldable tool comprising:

(a) a handle;

(b) a tool blade pivotally connected to said handle and pivotable thereto between extended and retracted positions, said tool blade having a base proximate said handle;

(c) said handle including spring means resiliently bearing against said base for deflecting to permit said tool blade to be pivoted between said extended and retracted positions;

(d) operable locking means for selectively substantially preventing said spring means from deflecting;

(e) said base of said blade including stop means for limiting the pivotal movement of said blade with respect to said handle; and (f) said locking means including abutment means for cooperating with said stop means to limit pivotable movement of said blade with respect to said handle.

13. A foldable tool comprising:

(a) a handle;

(b) a tool blade pivotally connected to said handle and pivotable thereto between extended and retracted positions, said tool blade having a base approximate said handle;

(c) said handle including spring means resiliently bearing against said base for deflecting to permit said tool blade to be pivoted between said extended and retracted positions;

(d) operable locking means for selectively preventing said spring means from deflecting; and (e) said locking means including a channel-shaped member having an intermediate web portion, said channel-shaped member being pivotally connected to said handle by a pin, said locking means adapted to be pivoted into a locking position with said web portion of said locking means engaging said spring means, preventing said spring means from deflecting.

14. The tool of claim 13 wherein said tool blade is pivotally connected to said handle by said pin.

* * * * *

UNITED STATES PATENT AND TRADEMARK OFFICE

CERTIFICATE OF CORRECTION

PATENT NO. : 4,888,869

DATED : December 26, 1989

INVENTOR(S) : Timothy S. Leatherman

It is certified that error appears in the above-identified patent and that said Letters Patent is hereby corrected as shown below:

| | | |
|---|---|---|
| Title page, item [54] & Column 1, line 1 | | Change "LOCK-BAR FOLDABLE TOOL" to --LOCK-BACK FOLDABLE TOOL--. |
| Col. 1, | Line 6 | Change "No.853,349" to --No. 853,349--. |
| Col. 2, | Line 25 | Change "jaws be" to --jaws may be--; |
| Col. 2, | Line 40 | Change "extension with" to --extension pivots with--. |
| Col. 4, | Line 42 | Change "arbitary" to --arbitrary--. |
| Col. 12, | Line 40 | Change "lifer" to --lifter--. |

Signed and Sealed this

Twentieth Day of October, 1992

*Attest:*

*Attesting Officer*

DOUGLAS B. COMER

*Acting Commissioner of Patents and Trademarks*